United States Patent [19]

Reponty

[11] Patent Number: 4,573,671

[45] Date of Patent: Mar. 4, 1986

[54] AUTOMATIC SETTING DEVICE FOR SLOWING DOWN A SIGNATURE PRIOR TO FOLDING IN PRINTING PRESS CHOPPER FOLDERS

[75] Inventor: André Reponty, Gouvieux, France

[73] Assignee: Harris-Marinoni S.A., Montataire, France

[21] Appl. No.: 730,647

[22] Filed: May 6, 1985

[30] Foreign Application Priority Data

May 7, 1984 [FR] France ..... 84 07024

[51] Int. Cl.[4] ..... B41F 13/56

[52] U.S. Cl. ..... 270/20.1; 493/21; 493/23; 307/141

[58] Field of Search ..... 270/20.1; 493/21, 23, 493/34, 416–418; 307/141

[56] References Cited

U.S. PATENT DOCUMENTS

| | | | |
|---|---|---|---|
| 2,458,544 | 1/1949 | Watson | 493/23 X |
| 2,516,454 | 7/1950 | Doran | 493/23 X |
| 2,643,879 | 6/1953 | Spreckelmeter | 493/23 |
| 2,871,010 | 1/1959 | Likens | 493/23 X |
| 2,940,751 | 6/1960 | Buss | 493/21 |
| 2,941,797 | 6/1960 | Buss | 493/21 |
| 3,212,771 | 10/1965 | Kerman et al. | 493/23 |
| 3,449,592 | 6/1969 | Jostrom | 493/21 |
| 3,692,303 | 9/1972 | Grantham | 493/21 |
| 3,698,705 | 10/1972 | Funk et al. | 493/23 X |

FOREIGN PATENT DOCUMENTS

| | | |
|---|---|---|
| 968486 | 9/1964 | United Kingdom . |
| 1356519 | 6/1974 | United Kingdom . |

*Primary Examiner*—E. H. Eickholt
*Attorney, Agent, or Firm*—Yount & Tarolli

[57] ABSTRACT

An automatic slow down setting device for a signature prior to folding thereof in chopper forders for web fed printing presses comprises a single detector of abutment of the signature, relay timing means connected to said detector and having an opening contact means and closing contact means, and two different phase setting motor control circuits, i.e. a "more advance" circuit with relay means and said closing contact, and a "less advance" circuit with relay means and said opening contact, and by means of which the signature can be precisely adjusted to abutment.

13 Claims, 5 Drawing Figures

AUTOMATIC SETTING DEVICE FOR SLOWING DOWN A SIGNATURE PRIOR TO FOLDING IN PRINTING PRESS CHOPPER FOLDERS

The invention is relative to a device intended to automatically set the signature being folded in the chopper folders used on the web fed printing presses.

The chopper folder device is well known by the web fed printing press makers.

It consists in making an extra fold on a signature already cut and folded and brought to the folding station thanks to two sets of belts.

The aim of the present invention is to automate the setting of the devices used to slow down the signature before folding.

Devices to automate the chopper phase shift are already known. These devices include two sensors sensing the signature position while moving, one is used to increase the advance and the other one to reduce it. The devices eliminate the folding on a headstop and are, hence, of little interest, the fold being then carried out "on the fly" and hence being not square. (see FIGS. 1 and 2 of the enclosed drawings).

The signature (1) to be folded is brought to the folding station between two sets of carrying belts (2) and (3). Belts placed under the signature coacting with belts (3) placed above it bring the signature (1) toward the headstop (4). This headstop (4) is grooved in front of the belts (2) and (3) in order to give way to them.

On the contrary the signature (1) is stopped on the headstop (4) which it cannot pass. Two folding rollers (5) rotating in reverse direction one to the other, are placed under the table (6) which is slotted in its center to give way to the signature (1) being folded.

An alternative chopper (7) rotatably mounted above the folding rollers (5) and fitted in such a way that its edge is parallel to the common contact generatrix of the two rollers (5) is used to introduce the signature between the folding rollers (5).

The chopper knife is hinged around a centerline (8) parallel to the one of the rollers (5) and receives its oscillating motion from a crank and rod mechanism (9) and (10). The drive of this crank and rod mechanism is made through the following mechanical drive: bevel gears (11 and 12), helical gears (13 and 14) and (15 and 16).

The gear (16) is driven in rotation by the shaft (17) linked to the folder drive, in such a way that for every signature produced by the folder, this shaft (17) rotates of one revolution.

It is conceivable that if the gear couples (15 and 16), on one hand (13 and 14) on the other hand and finally (11 and 12) are all in the 1 to 1 ratio, the chopper knife (7) will make one oscillation for every signature delivered.

The fastening of the crank (9) on its shaft is made in such a way that the chopper knife (7) touches the signature to fold (1) approximately at the very moment where it reaches the headstop (4).

The axial position of the helical gears (14) and (15) fastened between them is determined by a screw and nut device. The screw (18) is free to rotate but fixed lengthwise to the chopper frame. It screws into the nut (19) axially free but stopped in rotation and hence, by the intermediate of the ball bearing (20) axially moves the helical gear couple (14 and (15).

The screw is linked by gears (21) and (22) to an electric motor (23). Furthermore the nut (19) is fitted with limit switches (24) and (25) to limit the stroke of this nut and, consequently the stroke of the axial motion of gears (14) and (15).

The motor (23) is electrically controlled by a control cabinet (26) to which are also linked the limit switches (24) and (25).

A photocell (27) placed in a groove cut in the headstop (4) gives a signal every time the signature 1, while being folded, reaches the headstop (4).

This photocell is also linked to the control cabinet (26) which receives, furthermore, through a wire (28), a signal during all the time the machine minder depresses the button "faster" at the press control console in order to increase the press speed.

The whole device to move axialy the helical gear couple (14) and (15) allows the phase variation of the folding chopper knife (7) relative to the moment at which the signature (1) is reaching the headstop (4).

Indeed the axial motion of gear (15) toward the right, for example, induces a rotation of gear (14) and hence of gear (13). But the motion toward the right of gear (14) induces also a supplementary rotation of gear (13) which, being in the same direction as the first, adds to this rotation.

This system is well known by the knowledgeable people in the art and they use it currently in order to realize a phase shift of limited range.

It can be conceived that the signature (1) in its motion toward the headstop (4) squeezed between the two set of belts (2) and (3) is braked when the knife (7) touches it and make it come in contact with the fixed table (6), then the folding rollers (5).

The phase setting of the knife (7) relative to the moment where the signature (1) reaches the headstop, allows precisely the possibility to vary the distance from the headstop (4) at which the knife (7) touches the signature and this while the folder is running.

If the knife (7) touches the signature (1) while the signature is far from the headstop (4) (Large advance of the knife) then the signature 1 will never hit the headstop. It is then folded "on the fly" by the rollers (5-5) before reaching the headstop.

On the opposite, if the knife advance is too small or equal to zero, namely if the signature 1 reaches the headstop (4) at full speed and without having been braked by the knife (7) and the table (6), the signature will be marked or even torn in its shock on the headstop (4), when the folder is running at high speed.

The present invention describes an automatic device which allows the setting of the knife advance in such a way that the signature is "just" reaching the headstop (4) whatever are the stock weight, the number of pages of the signature or the various braking forces which can be applied to it: brushes, vacuum and for any speed of the press.

The invention is particularly directed toward a device to automatically set the signature slow down before folding in the chopper folders of printing presses charactized by the fact they include:

- Only one sensor to detect the coming of the signature to the headstop.
- A time delay relay in the circuit of this sensor and fitted with first closing contact and a second opening contact and,
- Two different circuits to control the phase setting motor:

A circuit "More advance" fitted with a relay and including the first contact, giving more advance until the sensor opens this first contact and shuts the second contact.

A circuit "Less advance" fitted with a relay and including this second opening contact, giving "Less advance" until the sensor shuts the first contact and opens the second, thus setting the signature "just" on the headstop.

Other caracteristics and advantages of the present invention will be better understood thanks to the following description made in regard of the drawings enclosed in which.

Figure 1:
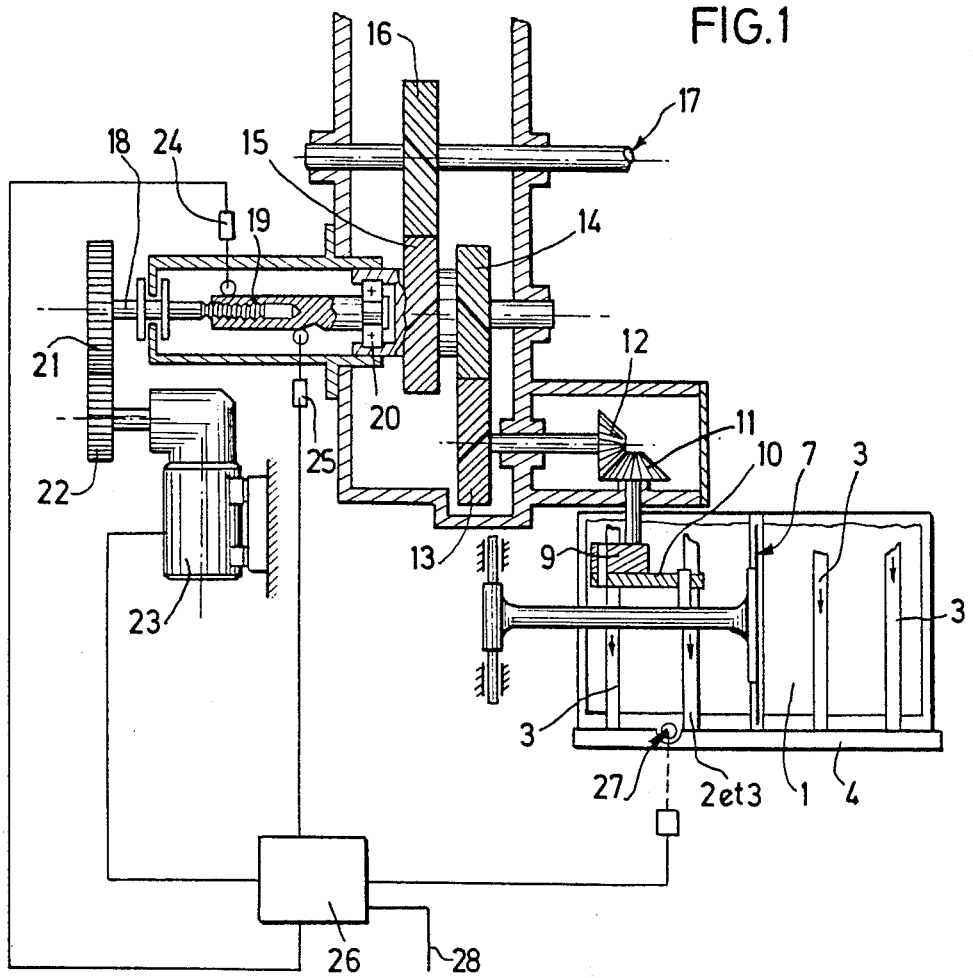
FIGS. 1 and 2 are respectively top view and front views of a known phase setting device used on a chopper folder.
Figure 2:
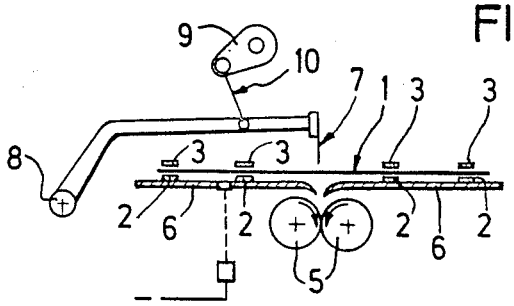
Figure 3:
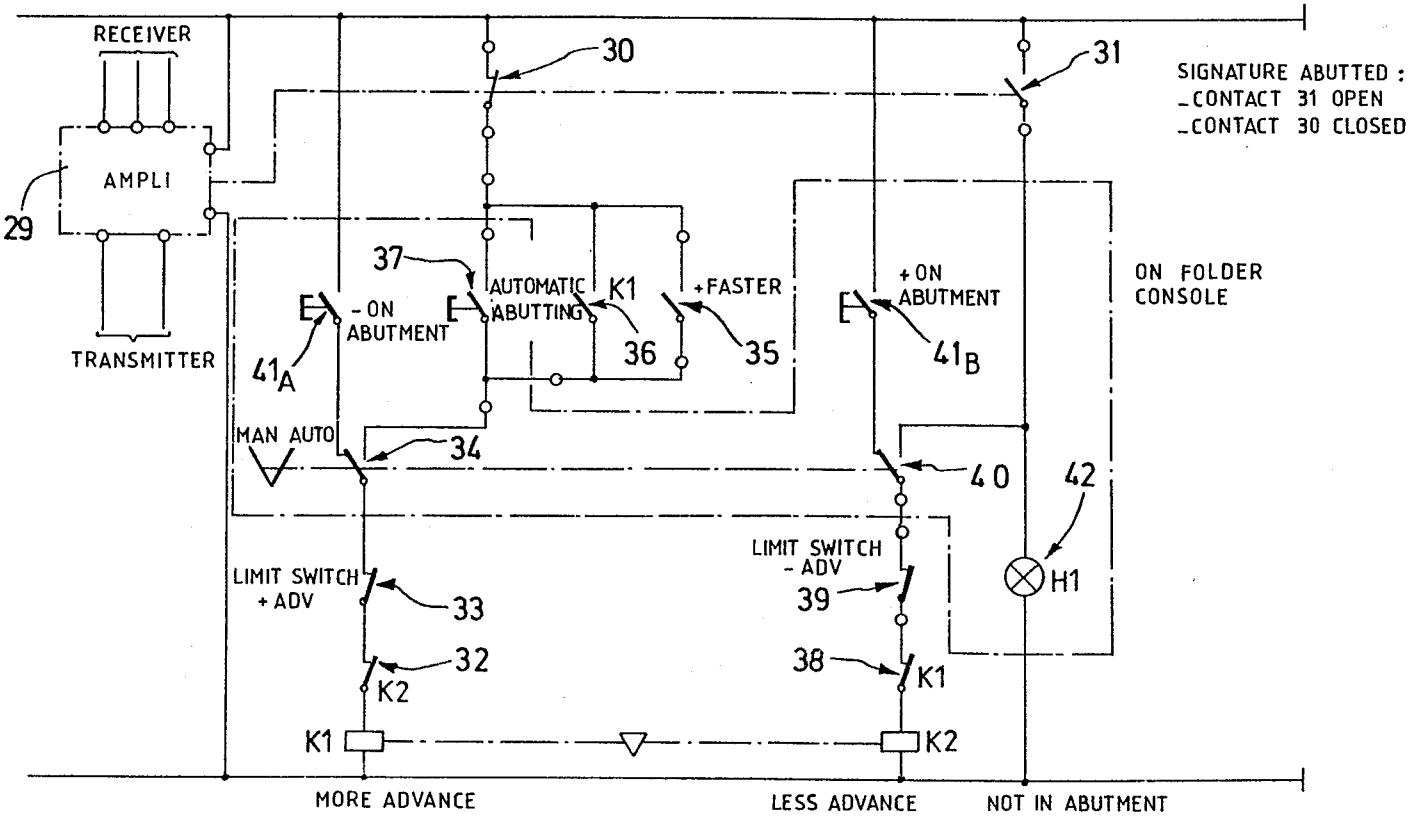
FIG. 3 is an electric diagram of a setting device conform to the invention.

The principle of the automatic setting device conform to the invention is as follows (see FIG. 3).

A time delay relay and amplifier of the photocell (29) which is fitted with a closing contact (30) and an opening contact (31) which receives the pulses coming from the photocell (27), which gives a pulse every time a signature, while being folded, reaches the headstop (4).

This relay is reset every time, if the pulses are coming with a period shorter than its setting time "t". If so, then a permanent signal "Signature to the headstop" is given by the relay.

On the opposite, it delivers a signal "Signature not to the headstop". The signal "Signature to the headstop38 stops the rotation in direction "More advance" of the phase setting motor (23). The signal "Signature to the headstop" makes this motor rotate in the direction "Less advance".

Furthermore, when the machine minder presses on the button "Faster" at the press control console, or on the button "automatic phase reset", while the signature folds on the headstop, the phase setting motor (23) rotates in the direction "More advance" until the signature is no longer on the headstop.

When the signature is no longer on the headstop, the phase setting motor restarts in the direction "Less Advance" in order to bring back the signature "Just" to the stop. The device conform to the invention, includes, furthermore two circuits to control the phase setting motor (23).

One control circuit in the direction "More advance", fitted with a relay (K1) and said contact (30).

One control circuit in the direction "Less advance", fitted with a relay (K2) and said contact (31).

The control circuit with the relay (K1) to drive the phase motor (23) in the direction "More advance" includes an electric interlock switch (32) linked with relay (K2), a limit switch "More advance" (33), a "Auto-Manual" reversing switch, in parallel, the push button switch "Faster" (35) of the control console of the press, and a self feeding switch (36) for the relay (K1), a button "Automatic Reset" (37) of said console and, a switch (30) for "Signature on the headstop".

The control circuit with relay (K2) to run the phase motor (23) in the direction "Less advance", includes:

a switch (38) to electrically interlock the relay (K1)

a limit switch "Less advance" (39)

an "Auto-Manual" reversing switch (40) and, a switch (31) for "signature on the headstop".

Furthermore, getting a manual control mode of the device, is possible by inverting switches (34) and (40) and controlling the phase motor thanks to the push buttons (40) "Away from headstop" and 4 "Toward headstop". A light (42) allows, in this case, the operator to know whether the signature is reaching, or not, the headstop before folding.

The working cycle can be described as follows: when the machine is running, if the signature never comes to the headstop, the switch (31) is closed and the phase motor rotates in the direction in which it reduces the advance. As less advance is made to the folding, the signature is folded nearer and nearer of the headstop until the photocell sees it which stops the phase motor by opening the switch (31).

If, while the machine is running, the machine minder is pressing the button "Faster" (35), while the signature is folded on the headstop the phase motor not being to its limit switch then relay (K1) which controls the phase motor will close and will auto feed itself due to the switch (36), running to more advance, until the photocell will no longer see the signature and will open the switch (30) and close the switch (31).

It can thus been understood that this device will always set the signature "just" to the headstop.

Variations can be brought to the invention, of which the above cited description has been made only as an indication, without departing from the scope of the invention.

For example, the sensor to detect the signature reaching the headstop can be either, a photocell as described hereabove, whether it is a transmission or a reflexion type photocell, or a pneumatic fluidic sensor, or even a mere electric switch or a piezo electric sensor or a capacitive or any other type of sensor.

In the same maner the chopper mechanism can also be of the well known "rotary" type, in which the knife or blade tip describes a curve known as a two cusp hypocycloid.

Finally, the phase shift can be performed also by an epicyclic gear train or by an harmonic drive, instead of the axial motion of helical gears described here, without departing from the scope of the invention.

Figure 4:
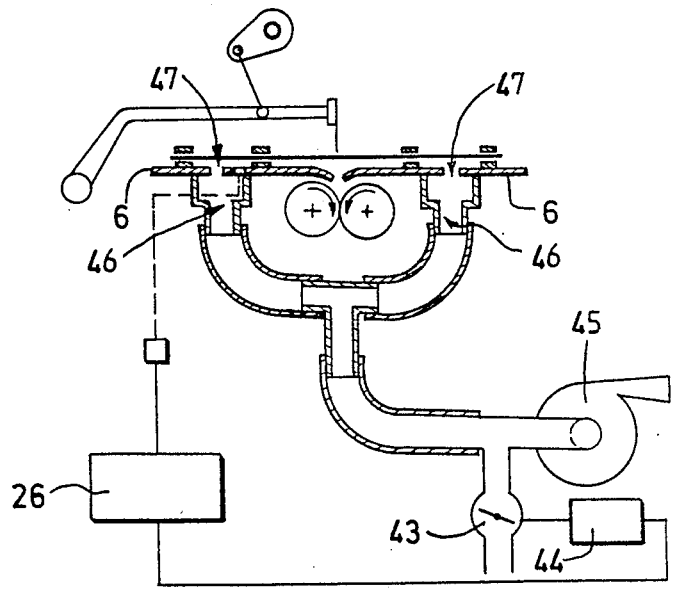
FIGS. 4 and 5 are respectively side view and top view of a vacuum slow down setting device.
Figure 5:
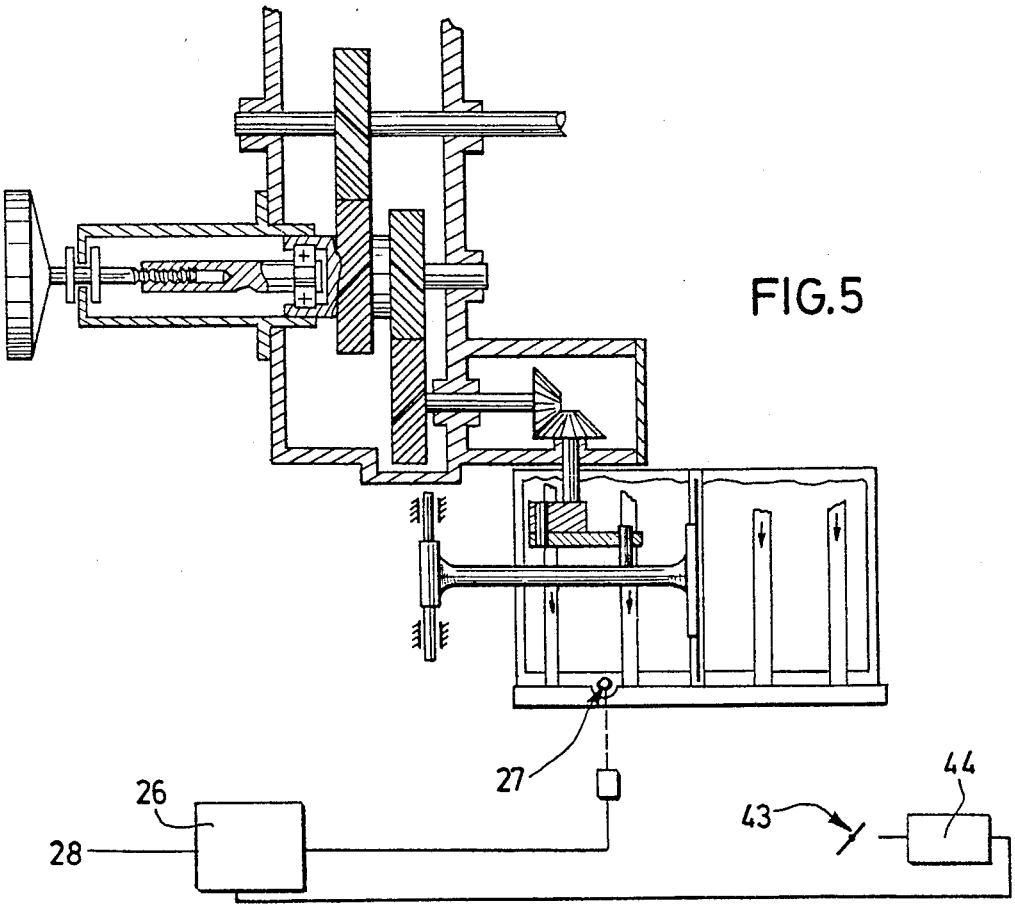

FIGS. 4 and 5 show a slow down action on the signature realized thanks to a vacuum force acting on the signature, as described in the French Pat. No. 83 09350 filed June 6th, 1983 in the name of this company.

A blower (40) realizes a partial vacuum in two boxes (41) fitted under the chopper table (6) and acting on the signature (1) thanks to a set of holes (42) drilled in the table.

The valve (43) mounted in "by pass" and linked to a motor is controlled by the automatic control device (26) acting by making "more vacuum" and "less vacuum".

In this case, the control of the chopper phase is made manually.

It would also be possible to control the pressure of the braking brushes usually fitted near the headstop thanks to the automatic control device (26).

In this case, the action would be "Increase the brush pressure", and "Reduce the brush pressure".

The invention covers also any combination of these various complementary ways to slow down the signature.

I claim:

1. A device for automatically setting signature slow down motion before folding thereof in chopper folders used on web fed printing presses, of a type including a sensor to detect the presence of the signature near the folding headstop, and means participating in the folding operation comprising a knife, rollers, vacuum holes, mechanical drive means, an electric motor to set the phase shift, braking brushes, wherein the setting device also comprises a single sensor to detect the presence of the signature to the headstop, a time delay relay linked to said sensor and fitted with a closing switch and an opening switch and two different control circuits for the phase setting motor, a "more advance" circuit with relay means and including the closing switch used to rotate in the "more advance" direction until the sensor opens said closing switch and closes said opening switch, an electric lock contact for relay means in a "less advance" circuit, a "more advance" end of travel contact, a "faster" push button in the press control console and a self-holding relay contact, both of the push button and the relay contact being mounted in parallel to one another, and said "less advance" circuit with relay means comprising said opening contact producing "less advance" until said sensor causes said closing contact to close and said opening contact to open, thereby obtaining precise setting of the signature in abutment.

2. A setting device according to claim 1 wherein the "more advance" circuit also comprises an automatic-manual reversing switch", an "automatic headstop reset" push button for said console.

3. A device according to claim 1 wherein said "more advance" circuit includes apart from said relay means and said closing switch an electric interlock switch for the relay means, a "more advance" limit switch, a "auto-manual" reversing switch in parallel, the "faster" push button at the control console, a switch to feed said relay means and an "Automatic headstop reset" push button for said console.

4. A device according to claim 1 wherein said "less advance" circuit includes besides said relay means and said opening switch, a switch for electrically interlocking said relay means a "less advance" limit switch an "Auto-Manual" reversing switch.

5. A device according to claim 1 wherein the slow down setting is done by phase setting performed by the motor on the chopper knife.

6. A device according to claim 2 wherein the slow down setting is done by phase setting performed by the motor on the chopper knife.

7. A device according to claim 4 wherein the slow down setting is done by phase setting performed by the motor on the chopper knife.

8. A device according to claim 1 wherein a slow down setting mode is realized by varying vacuum applied to a set of holes.

9. A device according to claim 2 wherein a slow down setting mode is realized by varying vacuum applied to a set of holes.

10. A device according to claim 4 wherein a slow down setting mode is realized by varying vacuum applied to a set of holes.

11. A device according to claim 1 wherein a slow down setting mode is realized by varying pressure applied to braking brushes.

12. A device according to claim 2 wherein a slow down setting mode is realized by varying pressure applied to braking brushes.

13. A device according to claim 4 wherein a slow down setting mode is realized by varying pressure applied to braking brushes.

* * * * *